US009951590B2

(12) United States Patent
Farrow

(10) Patent No.: US 9,951,590 B2
(45) Date of Patent: Apr. 24, 2018

(54) PLUNGER ASSEMBLY WITH DAMPENING SYSTEM

(71) Applicant: James T. Farrow, Grand Prairie, TX (US)

(72) Inventor: James T. Farrow, Grand Prairie, TX (US)

( * ) Notice: Subject to any disclaimer, the term of this patent is extended or adjusted under 35 U.S.C. 154(b) by 141 days.

(21) Appl. No.: 14/745,142

(22) Filed: Jun. 19, 2015

(65) Prior Publication Data

US 2016/0369595 A1 Dec. 22, 2016

(51) Int. Cl.
*E21B 37/10* (2006.01)
*E21B 43/12* (2006.01)

(52) U.S. Cl.
CPC ..... *E21B 43/121* (2013.01)

(58) Field of Classification Search
CPC ..... E21B 37/00; E21B 37/04; E21B 37/045; E21B 43/12; E21B 43/121; E21B 43/122
USPC ..... 166/68, 105
See application file for complete search history.

(56) References Cited

U.S. PATENT DOCUMENTS

| | | | | |
|---|---|---|---|---|
| 2,109,424 | A1 | 8/2015 | Jeffries | |
| 9,109,424 | B2 * | 8/2015 | Jefferies | E21B 34/08 |
| 2003/0155117 | A1 * | 8/2003 | Gray | E21B 43/121 166/107 |
| 2006/0065390 | A1 | 3/2006 | Amies et al. | |
| 2009/0038796 | A1 * | 2/2009 | King | E21B 23/06 166/277 |
| 2014/0246209 | A1 | 9/2014 | Themig | |
| 2014/0262204 | A1 | 9/2014 | Farris | |
| 2016/0108710 | A1 | 4/2016 | Hightower | |
| 2016/0168963 | A1 * | 6/2016 | Roycroft | E21B 43/121 166/105 |

OTHER PUBLICATIONS

Office Action in related U.S. Appl. No. 14/705,941, dated May 16, 2017, 13 pages.
Office Action in related U.S. Appl. No. 14/745,096, dated May 16, 2017, 14 pages.
Office Action in related U.S. Appl. No. 14/072,651, dated May 5, 2017, 15 pages.
Office Action in related U.S. Appl. No. 14/980,112, dated Aug. 22, 2017, 13 pages.

* cited by examiner

*Primary Examiner* — David J Bagnell
*Assistant Examiner* — Yanick A Akaragwe
(74) *Attorney, Agent, or Firm* — Law Office of Jeff Williams; J. Oliver Williams

(57) ABSTRACT

The present application includes and assembly having a rigid hollowed body and an internal dart configured to traverse the length of a well bore and remove contaminants. The body having a central channel for accepting the dart. The dart includes a central passage and an exit port to selectively permit the passage of working fluid around and through the dart. The dart is configured to transition between an extended position and a seated position. The body includes one or more restricted diameter sections to create a dampener effect to minimize and distribute the impact forces upon the assembly. The assembly optionally includes one or more external wear pads, and an expandable seal coupled to the body configured to expand in diameter from the increase in pressure in the well bore. The expandable seal contacts the walls as the assembly rises in the well.

19 Claims, 5 Drawing Sheets

PLUNGER ASSEMBLY WITH DAMPENING SYSTEM

BACKGROUND

1. Field of the Invention

The present application relates generally to oil field devices and, more particularly, to a plunger assembly with an internal dampening system.

2. Description of Related Art

The oil and gas industry has been drilling holes and removing natural crude oil for decades. Wells contain any number of contaminants, particulates, and water along with the gas/oil being sought. If water is not removed, pressure of the hydrostatic head of water in the surface tubing will become greater than that of the bottom hole pressure, thereby essentially sealing the formation and shutting in the well. Gas cannot on its own pressure typically flow to the surface.

Plungers are downhole tools used by operators to remove contaminants and water from productive natural gas wells. A plunger acts as an artificial lift. In operation the plunger passes down through the well until it reaches a contact point, at which point, potential energy of the plunger falling in the well acts to partially restrict the flow of working fluid through the plunger. Pressure beneath the plunger builds and raises the plunger in the well, thereby pushing out the liquids and contaminants above the plunger.

Typical plunger lift systems rely on the potential energy of the system falling in the well to generate enough force on a dart to seat the dart and create a seal. In other words, the contact itself sets the dart and generates the seal. Such designs generate a lot of forces on the tool and the equipment (i.e. the stop) at the bottom of the well upon impact. Tools are commonly damaged from the impacts.

Another disadvantage of traditional plungers are the inability to operate with various wells having different production rates. Wells that are high flowing provide a higher up force on a plunger system than a well that is low flowing. In order for a plunger to fall in a high flowing well, more fluid has to pass through the plunger. Tools typically fall slower through the wells that are high flowing. Low flowing wells allow tools to fall at much greater speeds and require a tool to restrict the flow of fluid through the plunger in order to regulate the speed of descent. If the speed is incorrectly gauged, a tool may struggle to fall in the well or a tool may fall too fast and incur damage upon impact at the bottom.

An additional disadvantage is the effect of a "drift diameter" restraining the size of the plunger in relation to the well bore. The drift diameter is the minimum inside diameter of the tube in order to pass a ridged tool of some set length through it. Tools are designed to have a maximum diameter no greater than the drift diameter of the tubing. This results in the tools having a gap between them and the ID of the tubing. The large annulus or gap between the tool and the tubing that the tools passes through are one reason why tools tend to be inefficient because plunger lift tools work on a pressure gradient between fluid beneath the tool and fluid above the tool. Leaks between the tool and tubing impact the pressure gradient.

Another disadvantage of conventional plunger lift systems are the particulates (i.e. sand) in the working fluid. The working fluid passes within the gap between the plunger lift system and the casing at increased speeds resulting in tools abrading quickly. Additionally, the leak leads to turbulence created around the down hole edge of the tool when it expands after passing through the leak.

A new plunger lift assembly tool is required that is adaptable for use on wells of varied flow rates, minimize abrading, and corrects for the constraints associated with the drift diameter.

Although great strides have been made, considerable shortcomings remain.

DESCRIPTION OF THE DRAWINGS

The novel features believed characteristic of the application are set forth in the appended claims. However, the application itself, as well as a preferred mode of use, and further objectives and advantages thereof, will best be understood by reference to the following detailed description when read in conjunction with the accompanying drawings, wherein:

Figure 1:
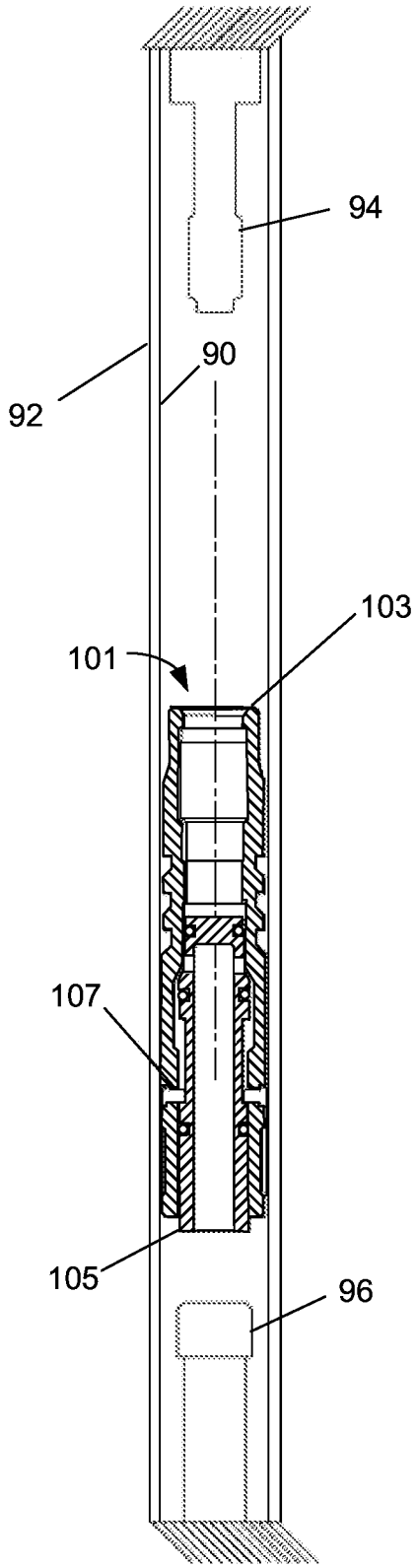
FIG. 1 is a side section view of a plunger assembly with an internal dampener in a well bore according to the preferred embodiment of the present application.

While the assembly and method of the present application is susceptible to various modifications and alternative forms, specific embodiments thereof have been shown by way of example in the drawings and are herein described in detail. It should be understood, however, that the description herein of specific embodiments is not intended to limit the application to the particular embodiment disclosed, but on the contrary, the intention is to cover all modifications, equivalents, and alternatives falling within the spirit and scope of the process of the present application as defined by the appended claims.

DETAILED DESCRIPTION OF THE PREFERRED EMBODIMENT

Illustrative embodiments of the preferred embodiment are described below. In the interest of clarity, not all features of an actual implementation are described in this specification. It will of course be appreciated that in the development of any such actual embodiment, numerous implementation-specific decisions must be made to achieve the developer's specific goals, such as compliance with system-related and business-related constraints, which will vary from one implementation to another. Moreover, it will be appreciated that such a development effort might be complex and time-consuming but would nevertheless be a routine undertaking for those of ordinary skill in the art having the benefit of this disclosure.

In the specification, reference may be made to the spatial relationships between various components and to the spatial orientation of various aspects of components as the devices are depicted in the attached drawings. However, as will be recognized by those skilled in the art after a complete reading of the present application, the devices, members, apparatuses, etc. described herein may be positioned in any desired orientation. Thus, the use of terms to describe a spatial relationship between various components or to describe the spatial orientation of aspects of such components should be understood to describe a relative relationship between the components or a spatial orientation of aspects of such components, respectively, as the device described herein may be oriented in any desired direction.

The assembly in accordance with the present application overcomes one or more of the above-discussed problems commonly associated with conventional plunger lift systems. The assembly 101 of the present application is configured to translate within the tubing of a well bore between a raised top position and a lowered bottom position. The raised top position is located at the surface of the well bore while the lowered bottom position is located at the base of the well bore deep within the ground. Specifically, the assembly is configured to provide an internal dampening effect on the dart as the dart contacts the bottom of the well bore. The dampening effect is designed to minimize the forces acting on assembly 101 at impact. Additionally, assembly 101 is configured to permit the removal of the dart without disassembly of the outer body. Wear pads are used to protect the outer body and an expandable seal is optionally used to provide many benefits described herein. These and other unique features of the assembly are discussed below and illustrated in the accompanying drawings.

The assembly and method will be understood, both as to its structure and operation, from the accompanying drawings, taken in conjunction with the accompanying description. Several embodiments of the assembly are presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless otherwise described.

The plunger assembly of the present application is illustrated in the associated drawings. The assembly includes a hollowed rigid outer body and a dart. A central channel passes through the outer body for passage and operation of the dart. The dart regulates the flow of working fluid through the outer body by engaging a single seat and a restricted diameter section. Also included is an optional expandable seal configured to selectively expand as a result of pressure built up below the assembly. The pressure within a central passage of the dart builds as an exit port is closed. The pressure expands (formation pressure beneath assembly 101 in the tubing of the well) the expandable seal so as to contact the walls of the tubing in the well bore.

Referring now to the drawings wherein like reference characters identify corresponding or similar elements in form and function throughout the several views. FIG. 1 illustrates plunger assembly 101 within tubing 90 of a well bore 92. Inside tubing 90 at the surface is a striker rod 94 configured to unseat the dart and permit assembly 101 to fall back through the well bore. At the bottom of the well bore is a bumper 96 (i.e. some type of equipment) used to push the dart into the outer body and seat the dart. The forces generated by assembly 101 during the fall through tubing 90 are transferred to assembly 101. After contact between the bumper 96 and the dart occurs, a pressure gradient begins to form from the formation pressure and causes assembly 101 to rise within tubing 90 toward the surface and striker rod 94. Assembly 101 is configured to translate and operate within tubing 90 between rod 94 and bumper 96. As assembly 101 rises within tubing 90, contaminants, particulates, and water above assembly 101 are brought to the surface. Assembly 101 is configured to operate with wells of varied flow rates.

As seen in FIG. 1, assembly 101 includes an outer body 103 having a hollowed channel 107 and a single seat 109. Body 103 is configured to raise and fall within tubing 90. Assembly 101 further includes a dart 105 in sealed communication with an internal surface 111 of body 103. Dart 105 is configured to translate within channel 107 between an extended position and a seated position. Dart 105 includes a central passage 113 and an exit port 115 to permit the selective passage of working fluid through body 103.

Figure 2:
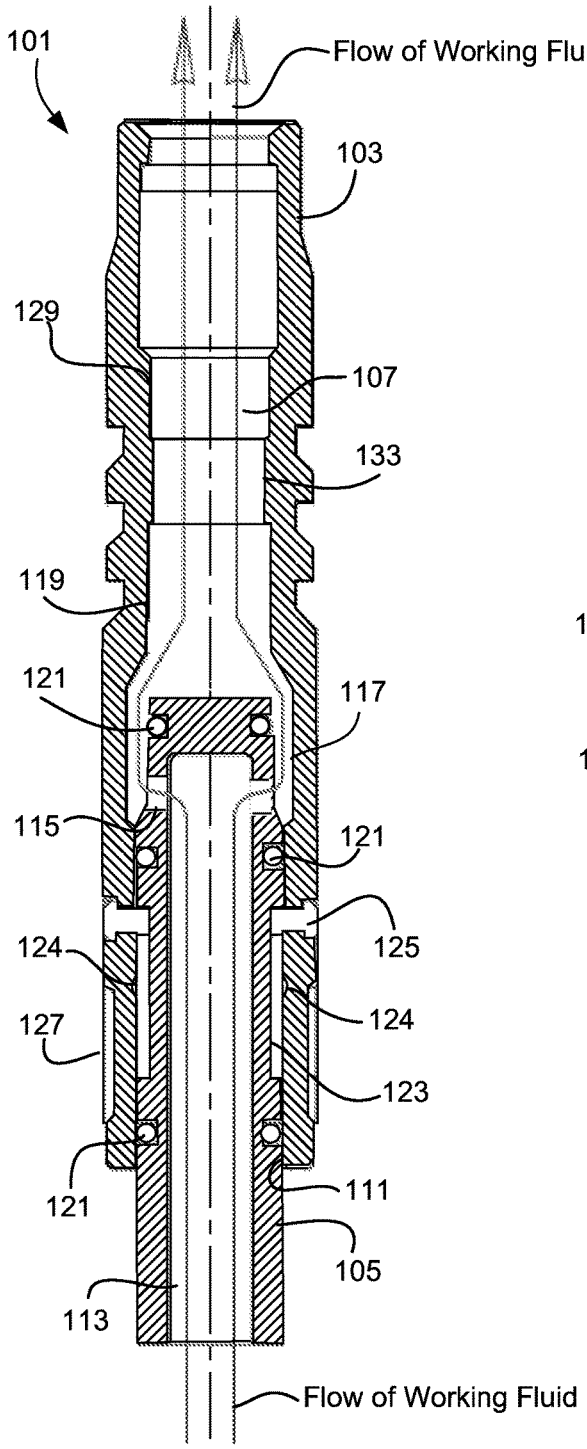
FIGS. 2 and 3 are enlarged side section views of the plunger assembly of FIG. 1 shown with a dart in a fully extended position and the dart in a seated position.
Figure 3:
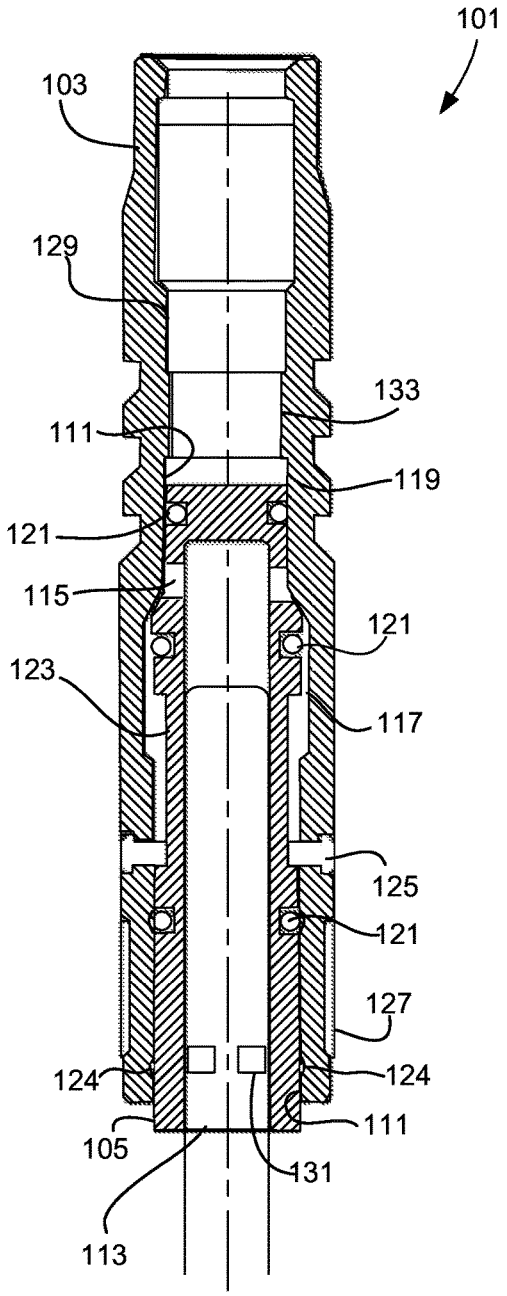

Referring now also to FIGS. 2 and 3 in the drawings, detailed side section views of assembly 101 with dart 105 in the different positions is illustrated. FIG. 2 shows assembly 101 with dart 105 in an unseated position with dart 105 extended below body 103. Dart 105 includes central passage 113 and exit port 115 to permit the flow of working fluid through assembly 101. Working fluid enters passage 113 axially and is routed around the upper portion of dart 105 by exiting dart 105 through exit ports 115. A central flow through dart 105 avoids directing working fluid around the exterior of assembly 101 adjacent tubing 90. Instead, working fluid is directed away from the annulus of tubing 90 by staying internal. This decreases the force pushing toward tubing 90 and helps to decrease abrasion around body 103.

Dart 105 is tapered to have a smaller diameter at the upper portion to assist in permitting working fluid passage. Additionally, body 103 is configured to have a groove 117 formed along inner surface 111. Groove 117 is configured to be located just below exit ports 115 when dart 105 is fully extended. This allows for the greatest flow of working fluid. The top of the upper portion of dart 105 is below a restricted diameter section 119 (i.e. a choke) of body 105 when dart 105 is fully extended.

As seen in FIG. 3, dart 105 is seated in restricted diameter section 119. Section 119 is a decreased diameter area of body 103 that is configured to restrict the flow rate working fluid around the top portion of dart 105. Working fluid is permitted to pass and a seal is not formed initially until the seals contact section 119. Use of section 119 allows for the impact forces acting on dart 105 and body 103 to be dispersed over time and reduce peak impact stresses. As dart 105 enters section 119, the flow of working fluid is restricted to a level lower than that seen in FIG. 2, therefore the speed of travel of dart 105 relative to body 103 decreases. Section 119 acts to create a dampening effect upon dart 105 and body 103 to minimize the impact forces experienced when contacting bumper 96.

In FIG. 3, dart 105 is fully seated in body 103. In this position, assembly 101 is configured to rise within tubing 90 from formation pressure below assembly 101 being greater than the pressure above assembly 101. Working fluid is unable to flow through central channel 107 of body 103 because exit ports 115 are blocked by restricted diameter section 119 and seals 121 (see below).

As seen in both figures, a plurality of seals 121 are used to seal the dart 105 to inner surface 107 of body 103. Seals 121 prevent the passage of working fluid between dart 105 and body 103, such that working fluid is forced to travel through central passage 113. A friction force exists between seals 121 and both dart 105 and body 103. The force is large enough to prevent the movement of dart 105 within body 105 when rising and falling within tube 90. In particular, body 103 includes a plurality of detents 124 along internal surface 111. Seals 121 are configured to expand into detents 124 when dart 105 is in an extended and seated position. Detents 124 are configured to secure dart 105 in the respective extended and seated position while assembly 101 is traveling between bumper 96 and striker rod 94. It is understood that pressure variations may occur or jolting may be experienced during translation between the upper surface and the bottom of well 92. Seals 121 are configured to maintain a sufficient force and friction to restrict the undesired and accidental translation of dart 105 within body 103 during translation of assembly 101 in tubing 90.

Dart 105 further includes a recessed section 123 adjacent internal surface 111. Recessed section 123 is configured to serve as a channel to retain dart 105 within body 103. Dart 105 further includes a removable key 125 configured to restrict the travel of dart 105 within body 103. Key 125 is configured to pass through body 103 and protrude into recessed section 123. As dart 105 operates between the extended position and the seated position, key 125 contacts either end of recessed section 123. Key 125 may be in threaded engagement or other type of interference fit. In one embodiment, key 125 is press fit into body 103 and welded in place. Any number of keys 125 and corresponding recessed sections 123 may be used around the periphery of dart 105. Some embodiments permit key 125 to be adjustable. The position of key 125 may be adjusted by setting it further within body 103 or by backing it out (i.e. threaded). Dart 105 may be removed through the lower portion of body 103 by backing out key 125 to be at least flush with internal surface 111 and pulling on dart 105. Therefore, dart 105 is removable and interchangeable from body 103 without the need for disassembly of body 103 or the removal of any other part. Key 125 may be retained within body 103 during removal of dart 105. It is understood that one or more keys 125 may be used. Furthermore, recessed section 123 may extend around the entire outer diameter circumference of dart 105 to permit dart 105 to rotate within body 105, or recessed sections 123 may be sized to coincide with the size of keys 125 forming a recessed strip parallel to the axis of dart 105.

Dart 105 may also further include one or more wear pads 127. The outer diameter of assembly 101 is within the drift diameter of tubing 90. A space exists outside of body 103 and the annulus or interior surface of tubing 90 that permits working fluid to pass around assembly 101 when falling. The working fluid contains any one of a number of contaminants, sand, particulates, solvents, and other foreign and harmful substances. The flow of working fluid around body 103 tends to cause a great amount of wear. The speed off working fluid is accelerated as it passes around body 105, increasing the tendency of wear. Wear pads 127 are configured to be spaced around the circumference of outer body 103. Other embodiments may located pads 127 in patches and space them in any location around body 103. A key feature of pads 127 is that they operate as sacrificial members. Pads 127 are configured to accept the wear from the contaminants within the working fluid as opposed to body 103. As wear pads 127 become worn, pads 127 are configured to be removed and replaced with a set of fresh pads. This prevents the need of having to rework or replace body 103 from wear. Pads 127 are coupled to recesses within body 103 via known attachment methods, such as an adhesive, fastener, or mechanical/chemical bonding. Pads 127 may be made from any type of polymer or hardened plastic.

In way of description, the upper portion of body 103 also includes a restricted diameter section 129 for operation with striker rod 94. Sections 129 and 119 operate to dampen the impact forces upon dart 105 from both striker rod 94 and bumper 96. This dampening effect permits assembly 101 to be used with wells having a variety of flow rates because the impact forces are experienced over a longer duration. It is understood that sections 129 and 119 may be configured to have a single constant diameter or may include a gradually narrowing diameter. The design of assembly 101 allows for striker rod 94 to be shortened. Other embodiments of assembly 101 may permit for the use and inclusion of striker rod 94. An additional option for use with assembly 101 is to include a flow restrictor 131 configured to releasably couple to a portion of dart 105 and partially obstruct a portion of central passage 113. Flow restrictor 131 may be internally coupled (within dart 105) or may be configured to couple to the base of dart 105 and contact bumper 96. Flow restrictor 131 may be mechanically/chemically bonded to dart 105, use one or more fasteners, or be secured through interference fit.

Figure 4:
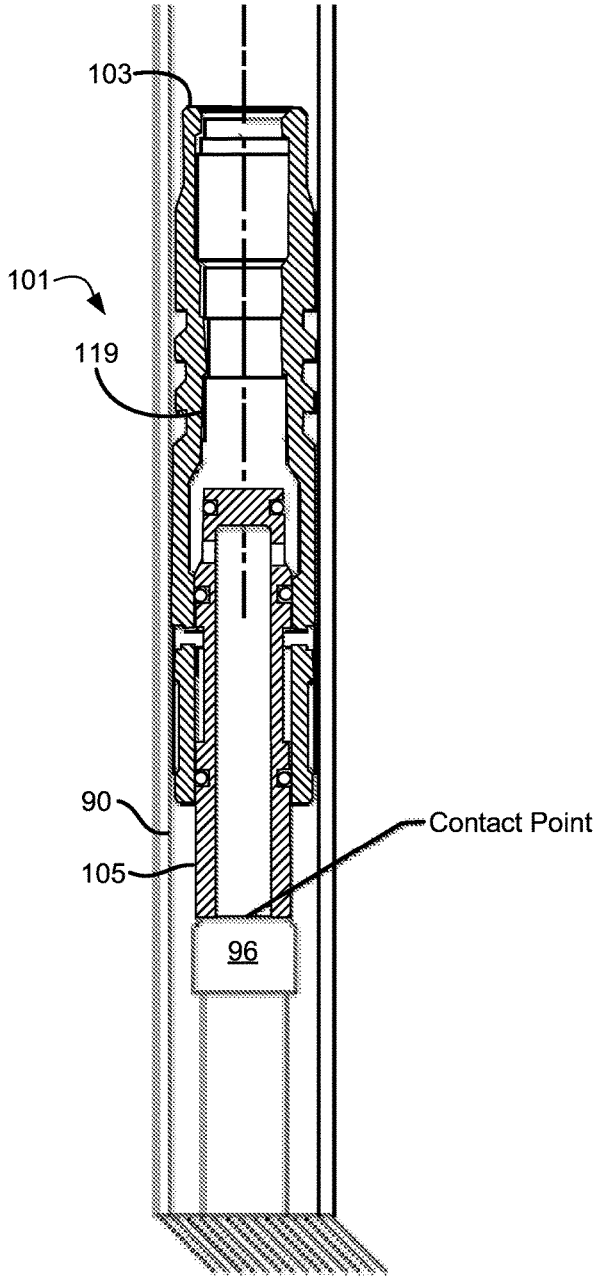
FIGS. 4 and 5 are side section views of the plunger assembly of FIG. 1 at the bottom of the well bore in contact with a bumper.
Figure 5:
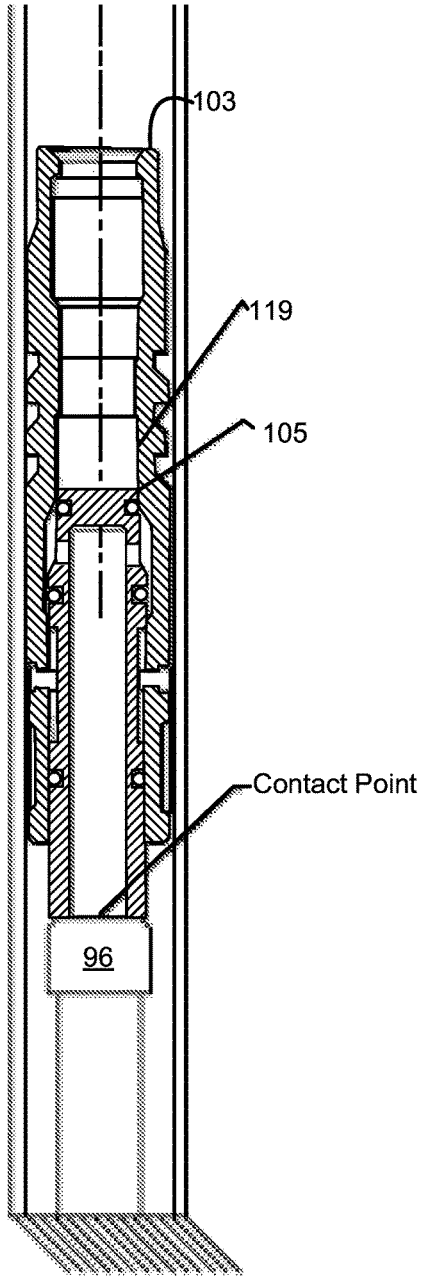

Referring now also to FIGS. 4 and 5 in the drawings, side section views of assembly 101 is illustrated at the bottom of well 92 showing the effects upon contact with bumper 96. In FIG. 4, dart 105 is in a fully extended position and working fluid has been allowed to pass through central passage 113 and ports 115 through the center of body 103. At contact with bumper 94, central passage 113 is closed off and impact forces stop the downward motion of dart 105, but body 103 is permitted to continue its downward motion. As seen in FIG. 5, as body 103 lowers sufficiently that the top of dart 105 engages or enters within restricted diameter section 119, the speed of body 103 begins to decrease rapidly in relation to the amount of working fluid permitted to pass. At the point at which seal 121 contacts section 119, pressure below dart 105 quickly rises. The pressures below assembly 101 may be sufficient to permit assembly 101 to begin to rise within tubing 90 despite dart 105 not being completely seated yet. The pressure differential in tubing 90 continues to press dart 105 further into restricted section 119 until fully seated.

Figure 6:
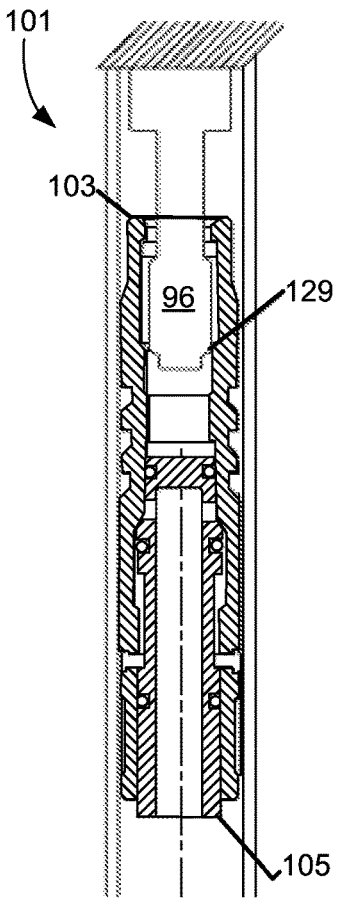
FIGS. 6-8 are side section views of the plunger assembly of FIG. 1 in at the top of the well bore in contact with a striker rod.
Figure 7:
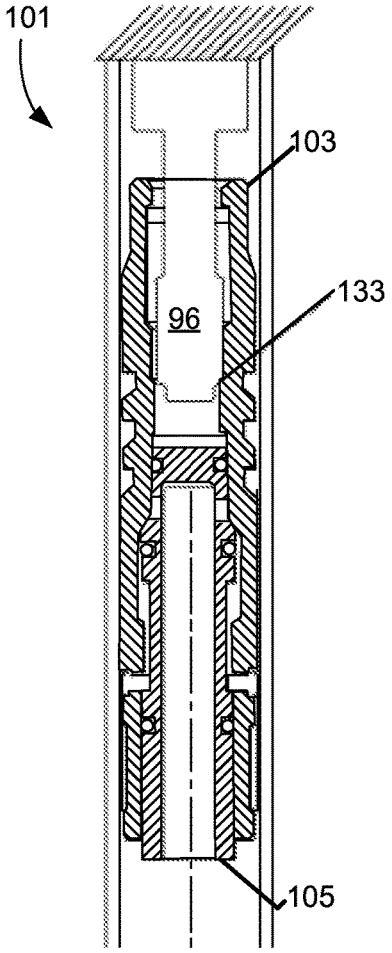
Figure 8:
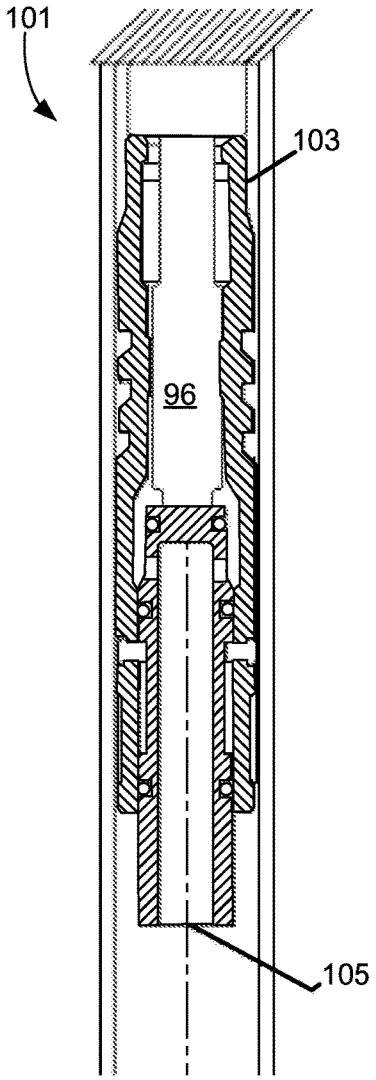

Referring now also to FIG. 6-8 in the drawings, side section views of assembly 101 is illustrated at the top of well 92 engaging striker rod 94 to show the effects of restricted section 129. Striker rods 94 may include one or more springs to absorb the impact forces of assembly 101. Often the back pressure in the well is regulated but situations arise where plunger assemblies can rise with too much speed and blowout through the well. Assembly 101 is configured to have utilize a series of decreasing diameter sections within channel 107 to choke/restrict the flow of working fluid as striker rod 94 progresses downward within assembly 101. Assembly 101 includes a restricted section 129 to provide the choke or dampening function prior to impact with striker rod 94. This removes the need for striker rod 94 to use springs to dampen the impact. However, use of section 129 and springs on striker rod 94 may be useful to help prevent blowouts.

In FIG. 6, rod 94 enters body 103 and engages section 129. At this moment, body 103 is slowed down by the restriction in volume of working fluid permitted to pass between rod 94 and body 103. Dart 105 maintains its position within body 103 through key 125. Rod 94 continues to progress through section 129 (as seen in FIG. 7) and reaches a second restricted section 133 which further restricts the available area permitted for working fluid to flow through. This further dampens and slows body 103 and dart 105. In FIG. 8, rod 94 is shown contacting dart 105 and translating it to a fully extended position. Body 103 is shown in contact with the base of rod 94. In this position, assembly 101 is permitted to fall back down within well 92.

Figure 9:
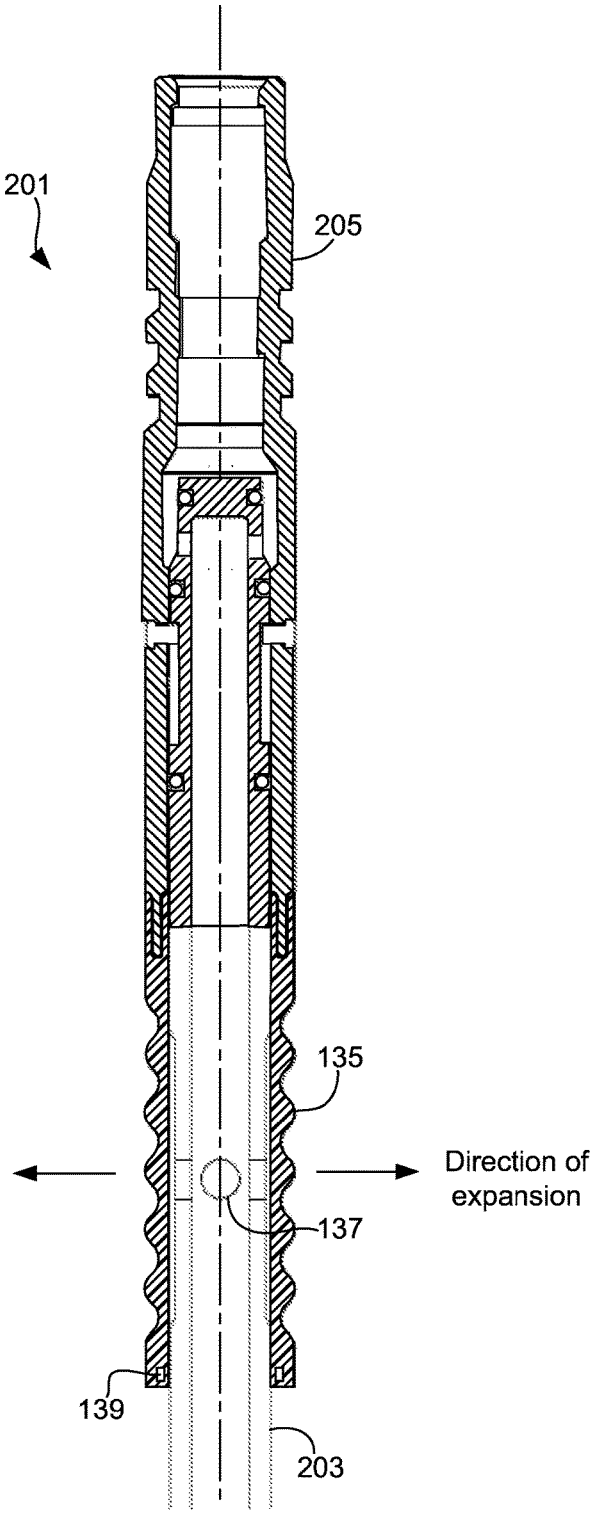
FIG. 9 is a side section view of an alternative embodiment of the plunger assembly of FIG. 1, having an expandable seal.
Figure 10:
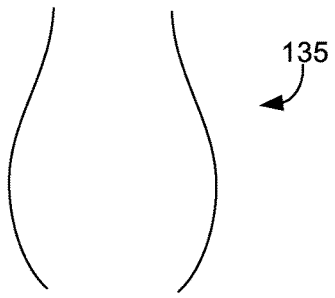
FIGS. 10-11 are exemplary illustrating the expansion of the expandable seal in the plunger assembly of FIG. 9.
Figure 11:
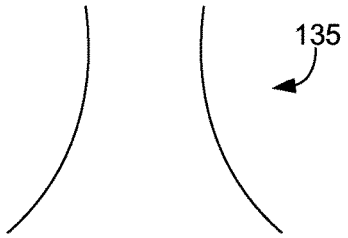

Referring now also to FIGS. 9-11 in the drawings, an alternative embodiment of assembly 101 further including an expandable seal 135 is illustrated. Assembly 201 is similar in form and function to that of assembly 101 and contains all the same features and limitations except as noted herein. Seal 135 is releasably coupled to body 203 at a lower most portion of the body, such that seal 135 is coupled to body 203 at a single end. The other end of seal 135 is configured to drape around dart 205.

As noted previously, when assembly 201 is at the bottom of well 92 and dart 105 engages section 119, fluid pressure beneath assembly 101 begins to increase. As the pressure differential grows compared to that of the fluid above assembly 101, assembly 101 begins to rise. Assembly 201 acts similarly. Seal 135 is configured to increase in diameter and contact tubing 90 as pressure beneath assembly 201 increases. The pressure level that this occurs as is less than the pressure level needed to raise assembly 201.

Dart 205 is identical to that of dart 105 except that dart 205 is lengthened to extend below seal 135 and dart 205 further includes a side port 137. Side port 137 is configured to permit the flow of working fluid to pass from central passage 213 outward to seal 135. Dart 205 includes a narrowed portion to form a gap between dart 205 and seal 135. Fluid passing through side port 137 fills the gap and pushes seal 135 outward to tubing 94. Seal 135 contacts the walls of tubing 94 and creates a seal against the wall. The pressure gradient continues to increase until it becomes large enough to begin lifting assembly 201 within the tubing. While raising to the surface, seal 135 rubs along the walls of tubing 94, acting to dislodge scale build up and clean the walls. When assembly 201 reaches the surface, the pressure is relieved and seal 135 reduces in diameter to a measurement within the drift diameter.

Working fluid within the tubing of the well bore contains a number of contaminants, debris, particulates, oils, and so forth that can be abrasive and damaging to objects and tools. There are many advantages of having seal 135 contact the walls of the tubing in the well bore, some of them are as follows: (1) Seal 135 rubs and scrapes the walls clean when rising. This serves to prolong the life of the tubing/casing and maintain the integrity of the well bore. (2) Scale buildup decreases the relative internal diameter of the tubing leading to potential clogging of tools. Seal 135 therefore maintains the drift diameter. (3) Seal 135 creates a seal against the walls that prevents the passage of working fluid (leakage). Therefore, creating the seal reduces abrading. (4) Contact between expandable seal 135 and the walls increases stabilization of assembly 201.

It is understood that there is a balance between the hardness and flexibility of seal 135. Seal 135 is hard enough to provide sufficient abrasion to the walls of well bore 92 but yet is flexible enough to expand at a pressure level lower than is necessary to lift assembly 201. Seal 201 is configured to have sufficient flexibility to accommodate variations in well bore diameter. Additionally, seal 135 may be configured to expand in different shapes. For example, as seen in FIG. 10, seal 135 may be configured to swell and expand in the middle. In this configuration, seal 135 optionally includes the use of an internal ring 139 which is configured to restrain the lower section of seal 135 from expanding under pressure. As seen in FIG. 11, seal 135 may be configured without ring 139 and expand by flaring out at the bottom. Use of ring 139 would help ensure that the undesired flaring of seal 135 does not occur while traveling downward in tube 94.

The current application has many advantages over the prior art including at least the following: (1) unobstructed central passage to permit passage of working fluid axially into the dart; (2) working fluid exiting the dart through the central channel of the upper body; (3) use of optional wear pads; (4) internal dampening system; and (5) an expandable seal prevents leakage of working fluid between the assembly and the walls of the well bore.

The particular embodiments disclosed above are illustrative only, as the application may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. It is apparent that an application with significant advantages has been described and illustrated. Although the present application is shown in a limited number of forms, it is not limited to just these forms, but is amenable to various changes and modifications without departing from the spirit thereof.

What is claimed is:

1. A plunger assembly for removing contaminants in working fluid within a well, comprising:

a single rigid outer body having a hollowed channel and a single seat, the hollowed channel being defined by an internal surface, the seat including a restricted diameter section and a stop;

a dart in sealed communication with the internal surface of the outer body and configured to translate within the hollowed channel between an extended position and a seated position, the dart having a central passage and an exit port for the selective passage of the working fluid through the outer body; and a flow restrictor releasably coupled to an interior surface of the dart within the central passage of the dart, the flow restrictor configured to regulate the flow rate of the working fluid through the central passage;

wherein the restricted diameter section of the outer body is configured to dampen forces transferred to the outer body as the dart transitions to the seated position.

2. The assembly of claim 1, wherein the dart is interchangeable within the hollowed body.

3. The assembly of claim 1, wherein the dart includes a recessed section adjacent the internal surface of the outer body and a removable key configured to restrict the travel of the dart within the outer body.

4. The assembly of claim 3, wherein the removable key protrudes through the outer body into the recessed section of the dart.

5. The assembly of claim 3, wherein the position of the threaded key may be adjusted in relation to the recessed section.

6. The assembly of claim 1, further comprising:

a seal configured to seal the dart to the outer body and prevent the passage of the working fluid between the dart and the outer body below the exit port.

7. The assembly of claim 1, wherein the restricted diameter section is configured to restrict the flow of the working fluid around the dart so as to slow the speed of travel of the dart relative to the outer body prior to being seated.

8. The assembly of claim 1, wherein the dart is configured to be removed from the outer body without the need for disassembly.

9. The assembly of claim 1, wherein the dart begins to rise within the well bore prior to the dart being seated.

10. The assembly of claim 1, further comprising:

a wear pad releasably coupled to an outer surface of the outer body.

11. The assembly of claim 10, wherein the wear pad is configured to protect the outer body from exposure to contaminants and particulates in the working fluid.

12. The assembly of claim 1, further comprising:

an expandable seal releasably coupled to the outer body, the expandable seal configured to increase in diameter and contact walls of the well.

13. The assembly of claim 12, wherein the expandable seal is coupled to the outer body at a single end, the expandable seal extending below the lowest portion of the outer body.

14. The assembly of claim 12, wherein the dart includes a secondary exit port in communication with an internal surface of the expandable seal, the pressure within the dart being pushed out through the secondary exit port to expand the expandable seal when the dart is seated.

15. The assembly of claim 12, wherein the diameter of the expandable seal expands and contacts the walls of the well when the dart is seated.

16. The assembly of claim 12, wherein the contact between the expandable seal and the walls occur as the assembly rises within the well.

17. The assembly of claim 12, wherein the contact during rising removes deposits and scales from the walls.

18. The assembly of claim 12, wherein contact between the expandable seal and the walls of the well are configured to increase stabilization of the assembly within the well.

19. The assembly of claim 12, wherein the expansion of the expandable seal minimizes leakage of working fluid between the assembly and the well.

* * * * *